US006456246B2

(12) United States Patent
Saito

(10) Patent No.: US 6,456,246 B2
(45) Date of Patent: Sep. 24, 2002

(54) ANTENNA DEVICE

(75) Inventor: Yuichiro Saito, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/766,408

(22) Filed: Jan. 22, 2001

(30) Foreign Application Priority Data

Jan. 25, 2000 (JP) ..... 2000-016360
May 15, 2000 (JP) ..... 2000-141947

(51) Int. Cl.[7] ..... H01Q 1/24
(52) U.S. Cl. ..... 343/702; 343/895
(58) Field of Search ..... 343/702, 700 MS, 343/895, 834, 720, 725, 727

(56) References Cited

U.S. PATENT DOCUMENTS 6,114,999 A * 9/2000 Cassel et al. ..... 343/702
6,124,831 A * 9/2000 Rutkowski et al. .. 343/700 MS
6,232,925 B1 * 5/2001 Fujikawa ..... 343/702

* cited by examiner

*Primary Examiner*—Don Wong
*Assistant Examiner*—James Clinger
(74) *Attorney, Agent, or Firm*—Jay H. Maioli

(57) ABSTRACT

An antenna device that can be housed within a small portable radio receiver can be obtained by miniaturizing a small loop antenna. A small antenna device is formed by connecting first ends of first and second spiral conductors to a feed portion and a short circuit portion, respectively, of a grounding conductor, and connecting the second ends of these first and second conductors with a third conductor having a specialized, nonlinear shape and being substantially perpendicular to respective axes of the first and second spiral conductors.

9 Claims, 15 Drawing Sheets

ANTENNA DEVICE

BACKGROUND OF THE INVENTION

1. Field of the Invention

The present invention relates to a miniaturization of a loop antenna, and particularly to an antenna device which can be miniaturized by using a grounding conductor.

2. Description of the Related Art

Heretofore, in antenna devices, a miniaturized loop antenna is widely used in which, when a physical size of a one-wavelength loop antenna element 1 shown in FIG. 14 is miniaturized without changing an electrical size thereof, as shown in FIG. 15, a loop antenna element 1*a* is miniaturized to a half-wavelength by using a grounding conductor 3. One end of this loop antenna element 1*a* is used as a short-circuit portion 4, and the other end thereof is used as a feed portion 2. The feed portion 2 supplies energy to the grounding conductor 3 via the half-wavelength loop antenna element 1*a* and the short-circuit portion 4, whereby the length of the loop antenna elment 1*a* can be reduced substantially to the half physically.

FIG. 16 shows an arrangement of the above-described antenna device in concrete. As shown in FIG. 16, one end of the half-wavelength loop antenna element 1*a* having substantially U-like shape is connected to the feed portion 2 and the short-circuit portion 4 is connected to the grounding conductor 3. The half-wavelength loop antenna element 1*a* having substantially U-like shape is made of a linear conductor and is comprised of a third conductor 6 made of a linear conductor formed between two conductors 5L and 5R and disposed parallel to the grounding conductor 3.

The antenna device described with reference to FIG. 16 has the folowing sizes. The length of a linear conductor portion 6*a* becomes 80 mm and the height of the conductors 5L and 5R become 40 mm even in 800 MHz band which is available in communication via a portable telephone, for example. This antenna device is large in physical size when it is used as an internal antenna device housed in the portable radio receiver or the like whose trend is being reflected on the miniaturization. Hence, this antenna device becomes increasingly difficult to be incorporated within the housing of the portable radio receiver or the like.

An PC card 9 conforming to the standards such as PCMCIA (Personal Computer Memory Card International Association) is inserted into a PC card slot 8 of a notebook size personal computer (hereinafter referred to as a "notebook size PC") when it is in use as shown in FIG. 17. The PC card is used in other devices such as LAN (Local Area Network) and a portable telephone.

The such PC card 9 includes a radio communication antenna portion 10. When radio communication is executed by using the PC card 9, there is employed an arrangement in which an antenna element 1 is erected from the antenna portion 10 as shown in FIG. 18 or an arrangement in which a meander-like pattern of the antenna element 1 is formed on the card substrate of the antenna portion 10 by patterning as shown in FIG. 19.

However, in the antenna shown in FIG. 18, the antenna should be erected each time the PC card is in use. Moreover, since the antenna is considerably projected to the outside when the PC card 9 is inserted into the notebook size PC 7, there arise problems that portability and operability of the notebook size PC 7 will be deteriorated.

Although the antenna shown in FIG. 19 exhibits satisfactory characteristics in a free space, there is a drawback that, under the condition that the PC card is inserted into the PC card slot 8 of the notebook size PC 7, the antenna portion is easily affected by the notebook size PC 7 and reception sensitivity will be lowered. Moreover, since the antenna portion 10 is considerably projected to the outside when it is inserted into the notebook size PC 7 similarly to the antenna arrangement shown in FIG. 18, there arise problems that portability and operability of the notebook size PC 7 will be degraded.

SUMMARY OF THE INVENTION

The present invention is made in order to solve the above-mentioned problems and is to provide an antenna device which can be housed into a suitable means such as a small mobile communication portable telephone housing and a PC card by miniaturizing a loop antenna element comprising the antenna device.

An antenna device according to the present invention is comprised of a first conductor shaped like a nonlinear conductor connected to a feed portion on a grounding conductor and which is disposed in the direction substantially perpendicular to the plane of the grounding conductor, a second conductor shaped like a nonlinear conductor connected to a short-circuit portion of the grounding conductor and which is disposed in the direction substantially perpendicular to the plane of the grounding conductor and a third conductor connecting the first conductor and the second conductor and which is integrally formed in substantially parallel to the grounding conductor, wherein the first and second conductors are shaped like spiral conductors and the third conductor is shaped like a meander conductor.

According to the antenna device of the present invention, the one-wavelength loop antenna can be miniaturized and can be used in a mobile communication portable radio receiver and a PC card.

DESCRIPTION OF THE PREFERRED EMBODIMENTS

Figure 1A:
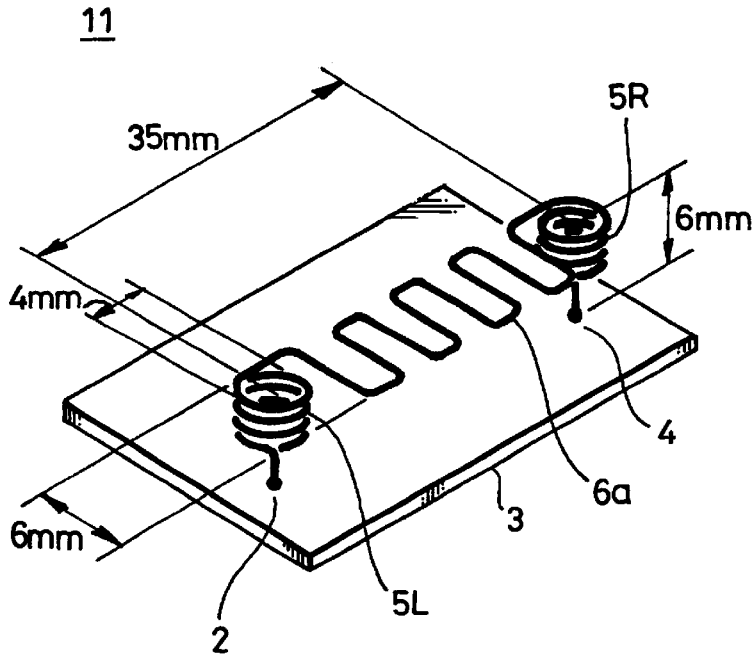
FIGS. 1A and 1B are perspective views showing an antenna device according to an embodiment of the present invention and to which reference will be made in explaining a principle of the present invention.

An embodiment of the antenna device according to the present invention will hereinafter be described with reference to the drawings, in which parts corresponding to those of FIGS. 14 to 19 are marked with the same reference numerals.

Figure 1B:
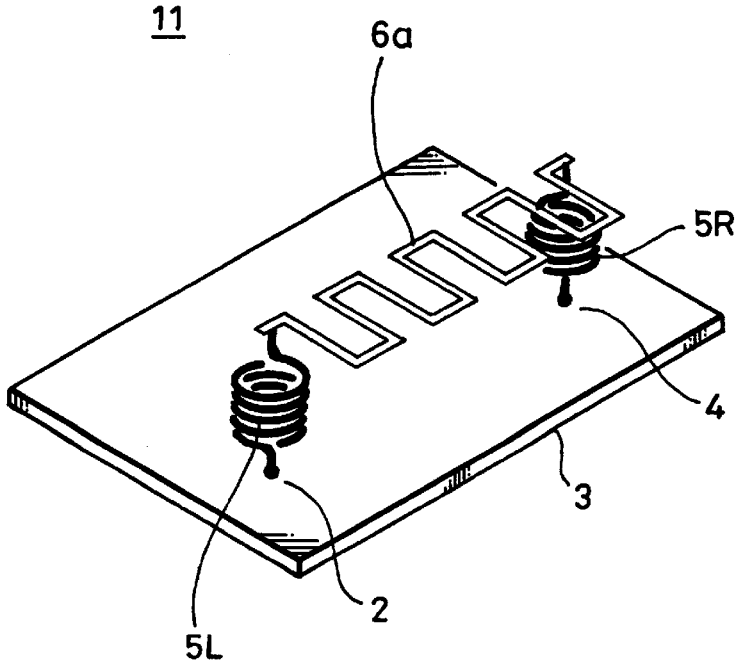

FIGS. 1A and 1B are perspective views showing antenna devices according to an embodiment of the present invention. As shown in FIG. 1A, 5L and 5R are formed as spiral-like conductors of linear conductors such as piano wires and phosphor bronze. First spiral-like conductor 5L is electrically connected to the feed portion 2 provided on one end of the grounding conductor 3. One end of second spiral-like conductor 5R is soldered to the short-circuit portion 4 of the grounding conductor 3 and thereby held at a ground potential.

Between open end sides of the both first and second spiral-like conductors 5L, 5R, there is disposed a nonlinear (curved) third conductor 6*a* having a proper shape such as a meander-like, a comb-like, a sawtooth-like and a sine-wave-like shape formed by zigzagging a piano wire, a phosphor bronze or the like made of a linear conductor. This third conductor 6*a* is shaped like a curved parallel portion substantially parallel to the major surface of the grounding conductor 3 and which is winding in the direction perpendicular to a line (corresponding to the third conductor 6 in FIG. 6) connecting spiral-like centers of the first and second conductors 5L and 5R. FIG. 1A shows the case in which the third conductor is formed as a meander-like shape. The respective ends of this third conductor 6*a* are connected to open ends of the first and second conductors 5L and 5R by soldering or contacting. The first conductor 5L, the third conductor 6*a* and the second conductor 5R are integrally formed in a U-like shape, the other end of the second conductor 5R is grounded to the short-circuit portion 4 of the grounding conductor, the other end of the first conductor 5L is connected to the feed portion 2 and power is supplied from the feed portion 2 to the short-circuit portion 4, thereby resulting in an antenna device 11 being formed.

In the above-described antenna device, parameters for determining the length of the antenna element such as the number of turns of the zigzag of the third conductor 6*a*, the interval of zigzag portions, the winding radius, the winding number, the pitch and the height of the first and second conductors 5L, 5R may be properly determined depending upon available frequency bands.

Figure 16:
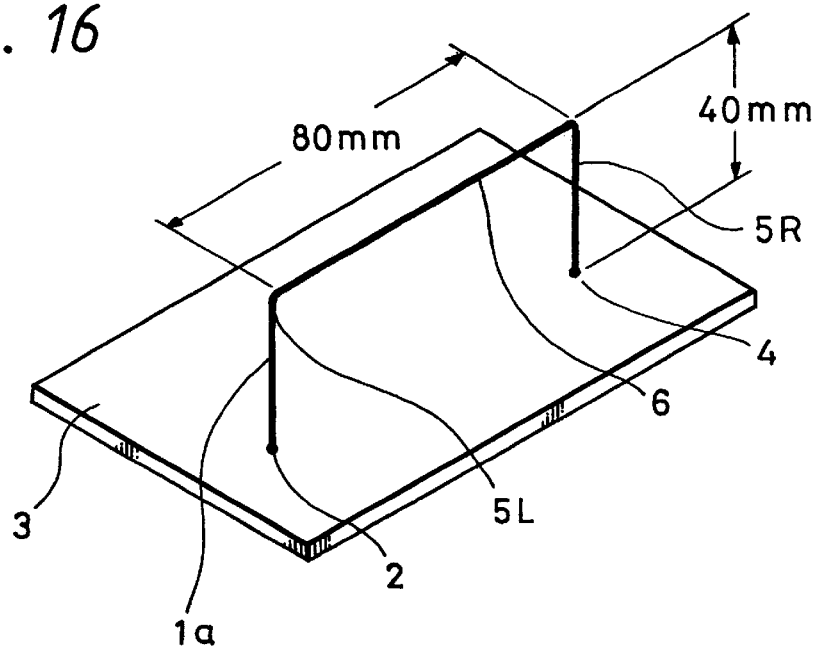
FIG. 16 is a perspective view of a small loop antenna according to the prior art.

Sizes of respective portions of a small loop antenna of 800 MHz band similar to the conventional antenna shown in FIG. 16 can be extremely miniaturized such that, as shown in FIG. 1A, the diameter of the spiral-like portion of the first conductor 5L is 4 mm, the height of the first and second conductors 5L, 5R is 6 mm, the width of the zigzag portion of the third conductor 6*a* is 6 mm and the length thereof is 35 mm.

In the antenna device 11 having the above-described arrangement, when the respective ends of the third conductor 6*a* and each one end of the first and second conductors 5L, 5R is connected, the third conductor 6*a* is disposed along a line connecting the centers of the circles of respective bases of the first and second conductors 5L and 5R. The third conductor is not always disposed on the line connecting these centers but may be disposed at slightly distant positions and its both ends and the open ends of the first and second conductors 5L and 5R may be connected by a suitable means such as conductors. The spiral-like conductors 5L and 5R may be formed not as dead cores and may be wound around dielectric rods erected on the grounding conductor 3.

Further, while the feed portion 2 and the short-circuit portion 4 of the grounding conductor 3 are disposed on the same grounding conductor 3 as shown in FIG. 1A, these elements need not be formed on the same grounding conductor 3.

FIG. 1B shows the case obtained when the third conductor 6*a* is shaped as a meander-like conductor by forming a belt-like or sheet-like conductor such as copper foil or copper plate in a zigzag fashion and is connected to open ends of the first and second conductor 5L and 5R. The rest of the arrangement is the same as that of the arrangement shown in FIG. 1A.

Figure 2A:
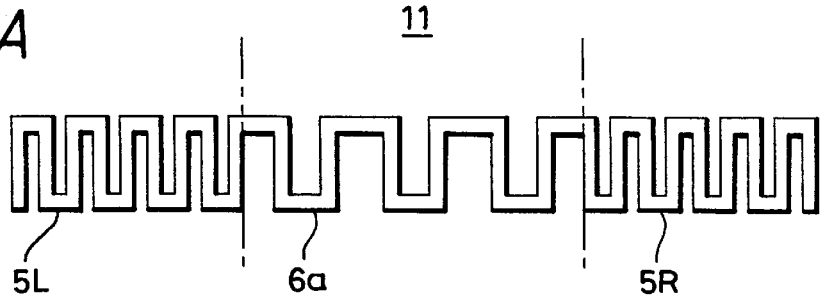
FIGS. 2A to 2D are plan views and a schematic perspective view showing an antenna device according to another embodiment of the present invention.
Figure 2B:
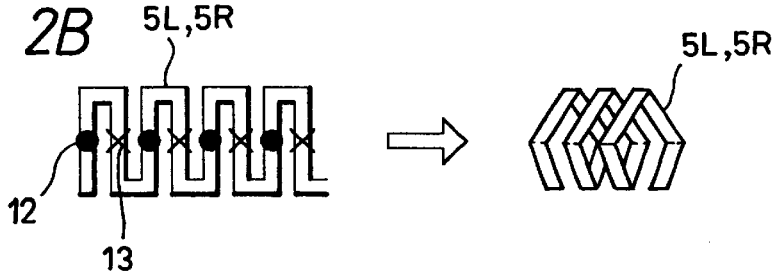
Figure 2C:
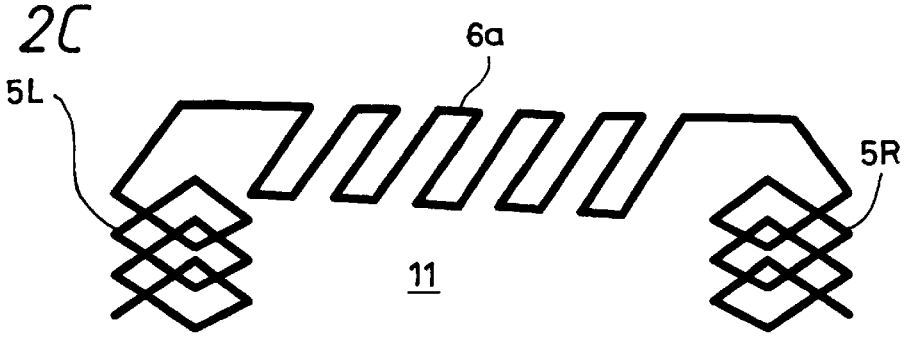

FIGS. 2A, 2B, 2C show another arrangement of the antenna device according to the present invention. The first and second conductors 5L, 5R and the third conductor 6*a* are formed of band-like or sheet-like members, the rising portions 5L and 5R and the parallel portion 6*a* are made different in pitch and integrally formed as zigzag-like by a suitable means such as press and respective ends of the third conductor 6*a* are bent at a right angle in the upper or lower direction as shown by dotted lines, thereby shaping substantialy U-shape and forming the antenna device 11.

In this case, when solid-circle portions 12 are bent in the upper direction of the sheet of drawing and cross-mark portions 13 are bent in the lower direction of the sheet of drawing in order to form the first and second conductors 5L, 5R as spiral-like as shown in FIG. 2B, it becomes possible to form the conductors 5L, 5R as spiral-like as shown by an arrow A.

FIG. 2C is a perspective view showing the arrangement of the antenna device which is formed by bending a linear conductor according to a method similar to those of FIGS. 2A, 2B.

Figure 2D:
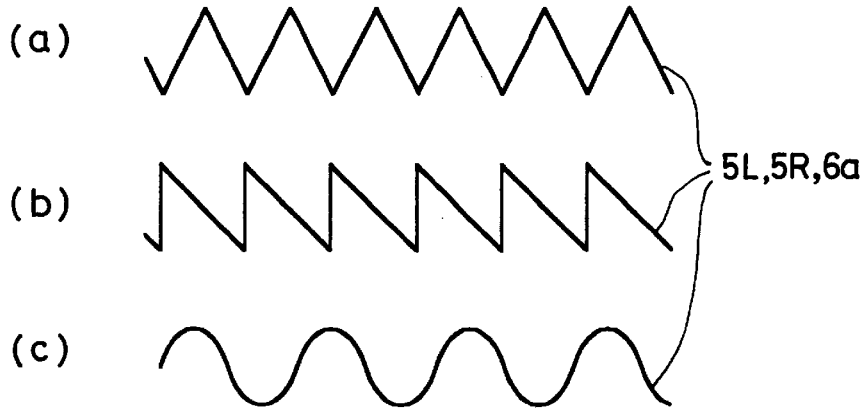

"a", "b", "c" in FIG. 2D are plan views showing various shapes of nonlinear portions (curved portions) other than the meander-like shape (comb-like shape) and show shapes that can be modified when the first and second conductors 5L and 5R and the third conductor 6*a* are formed integrally as shown in FIG. 2A. "a" in FIG. 2D shows the case in which the nonlinear portion is shaped like a zigzag portion (triangular portion), "b" in FIG. 2D shows the case in which the nonlinear portion is shaped like a sawtooth-like portion and "c" in FIG. 2D shows the case in which the nonlinear portion is formed as a sine-wave-like portion. The present invention will be described on the assumption that the nonlinear portion is shaped like the meander-like portion including "a" "b" "c" of FIG. 2D.

Figure 3A:
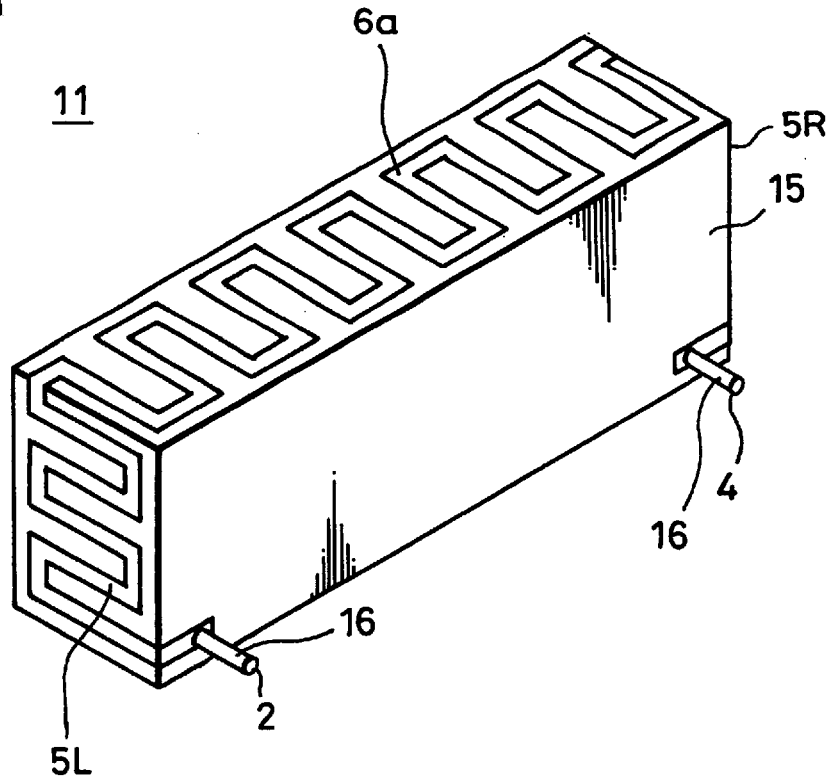
FIGS. 3A and 3B are perspective views (I) showing an antenna device according to still another embodiment of the present invention.
Figure 3B:
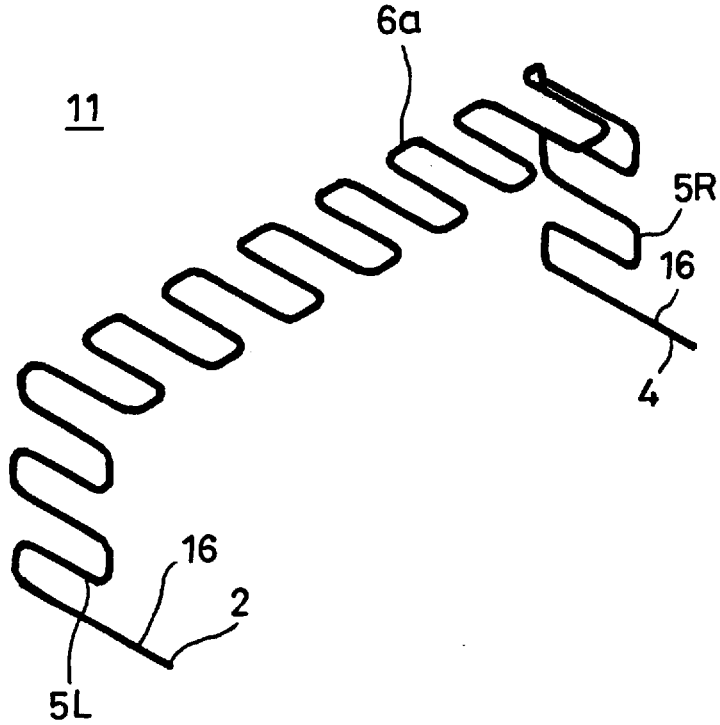

FIGS. 3A and 3B show still another arrangement of the antenna device 11 according to the present invention. FIG. 3A shows the case in which the first and second conductors 5L, 5R and the third conductor 6*a* are both integrally formed of a sheet-like conductor or a linear conductor like meander-like portions, embedded into a predetermined insulating member 15 within the portable radio receiver or attached to or patterned to this insulating member 15, pin portions 16, 16 are formed integrally with the first and second conductors 5L, 5R and tip ends of the pin portions 16, 16 are joined to the feed portion 2 and the short-circuit portion 4 of the grounding conductor 3.

Figure 4A:
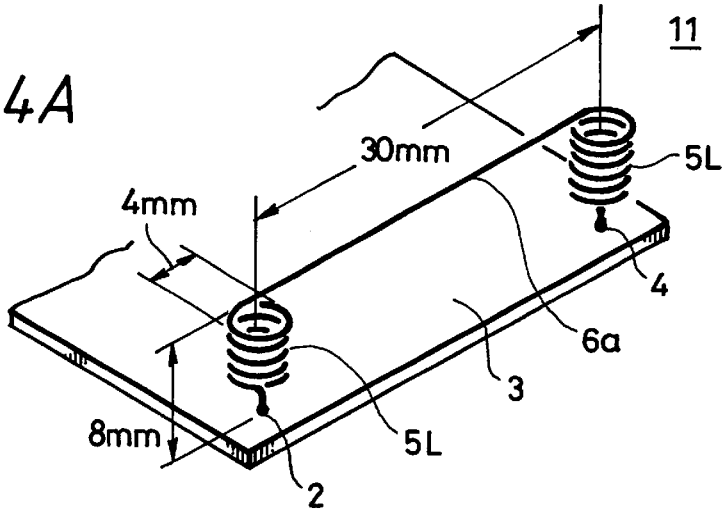
FIGS. 4A to 4C are a perspective views (II) showing still another example of the antenna device according to the present invention.
Figure 4B:
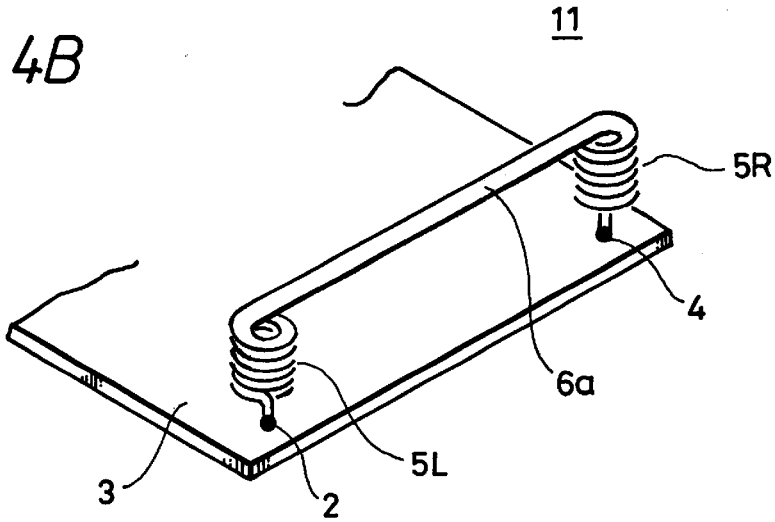
Figure 4C:
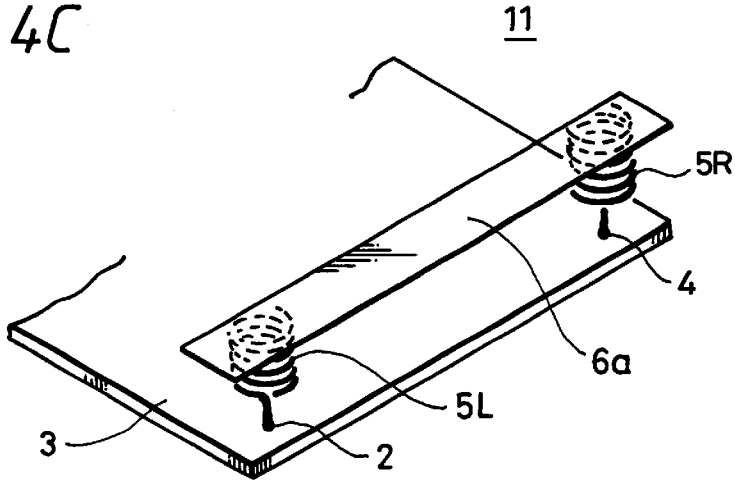

FIGS. 4A to 4C are diagrams showing still another example of the antenna device according to the present invention and show the case in which the third conductor 6*a* connected between open ends of the first and second conductors 5L and 5R formed of a linear conductor described with reference to FIG. 1A is formed of a linear conductor as a linear parallel portion. The rest of the arrangement is similar to that of FIG. 1A.

In this antenna device 11, the third conductor and the first and second conductors can be integrated with each other by electrically contacting the respective ends of the linear third conductor 6*a* and each one end of the spiral-like first and second conductors 5L, 5R or by connecting them by soldering. Moreover, the above-described arrangement can be made by the linear conductor such as a single piano wire or phosphor bronze, for example.

In the above-described antenna device, sizes of respective portions obtained in the case of the small loop antenna device of 1.8 GHz band similar to the conventional loop antenna device described with reference to FIG. 16 can be extremely reduced in such a manner that the diameter of the spiral-like portions of the conductors 5L, 5R is 4 mm, the height of the first and second conductors 5L, 5R is 8 mm and the length of the linear third conductor is 30 mm.

FIG. 4B shows the case in which the first and second conductors 5L and 5R and the third conductor 6*a* are shaped like not linear portions but belt-shaped portions and the antenna device 11 having a U-like shape can be integrally formed by press-treatment of a sheet-like conductor such as a phosphor bronze.

FIG. 4C shows the case in which the first and second conductors 5L and 5R are formed of a linear conductor like spiral-shaped conductors and respective ends of the third conductor 6*a* that had been pressed as the belt-like portion are joined to the open ends of the first and second conductors 5L and 5R.

The widths of the belt-like conductors shown in FIGS. 4B and 4C may be determined based on available frequencies of the portable radio receiver using the antenna device.

Figure 5A:
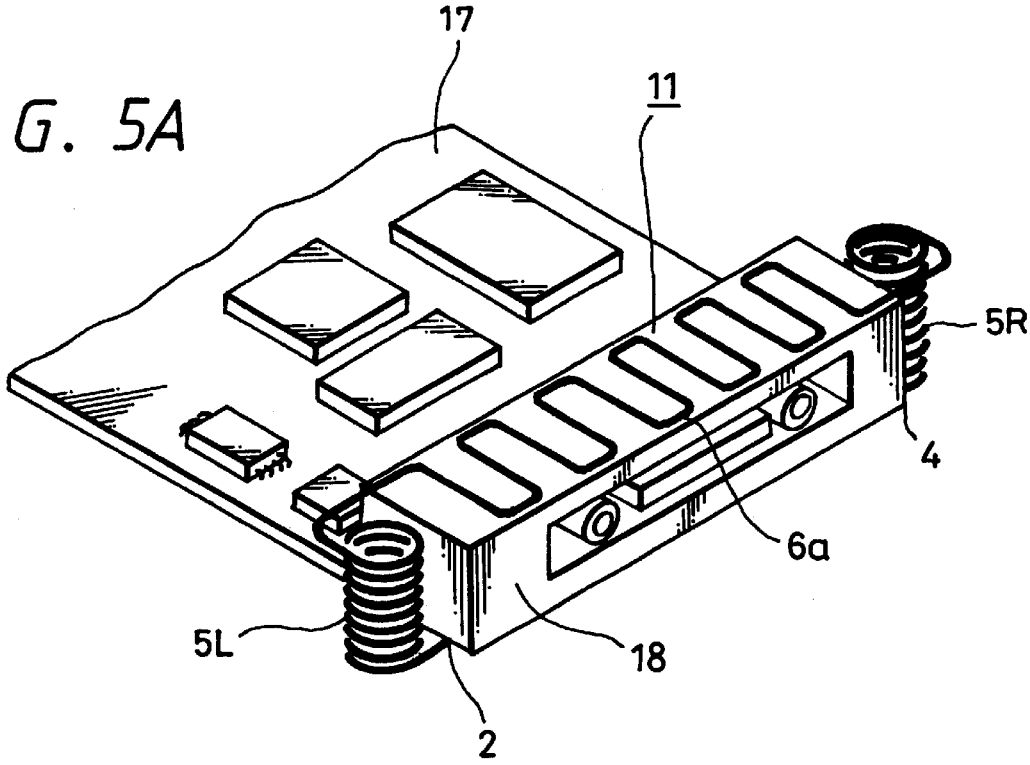
FIGS. 5A and 5B are perspective views showing the attachment states of antenna devices according to the present invention.
Figure 5B:
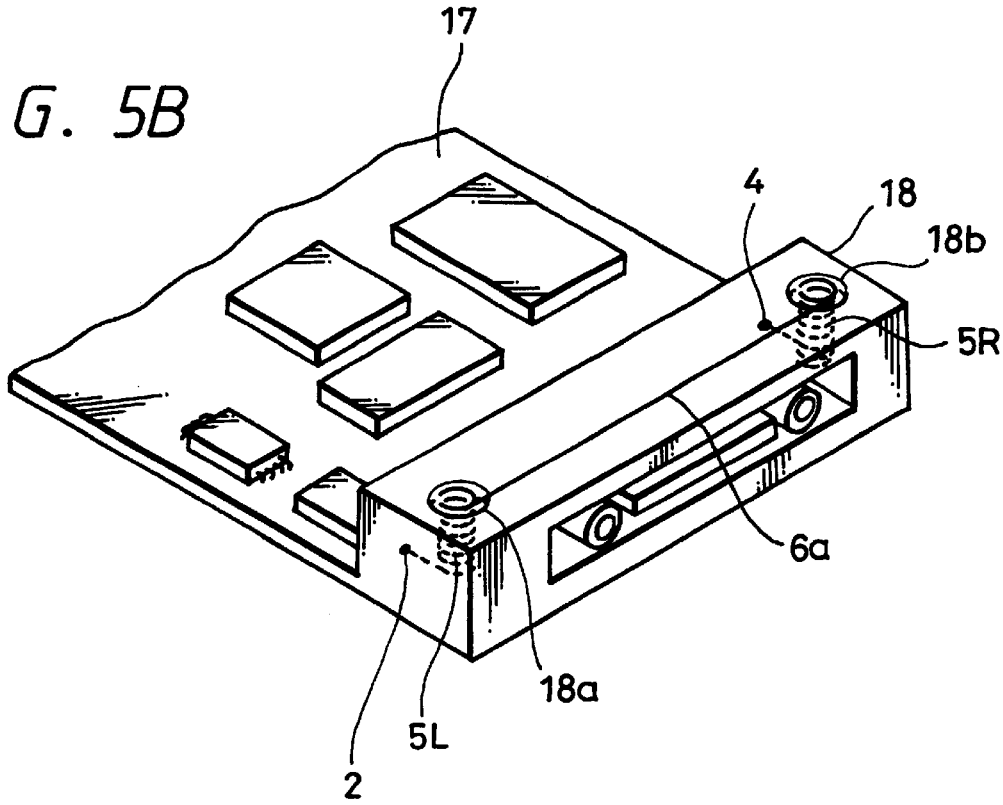

FIGS. 5A and 5B show arrangements obtained when the antenna device 11 having the above-described arrangement is attached to a substrate 17 of a portable radio receiver such as a portable telephone. FIG. 5A shows the case in which the antenna device 11 is attached to the substrate so as to surround an external connector 18 of a portable radio receiver and in which each one end of the spiral-like first and second conductors 5L, 5R is joined to the feed portion 2 and the short-circuit portion 4 provided on the substrate 17 by soldering or the spiral-like first and second conductors 5L, 5R are brought in contact with the feed portion 2 and the short-circuit portion 4 under spring-force thereof. In this case, the external connector 18 may be used as a connecting plug such as an external antenna when the portable radio receiver is a portable telephone or the like.

FIG. 5B shows the case in which the first and second conductors 5L and 5R are housed within the external connector 18 and in which each one end of the spiral-like first and second conductors 5L and 5R is joined to the feed portion 2 and the short-circuit portion 4 provided on the substrate 17 by soldering, the spiraled portions are inserted into through-holes 18*a* and 18*b* defined on the external connector 18 and the linear third conductor 6*a* is disposed so as to be laid on the external connector 18.

Figure 6A:
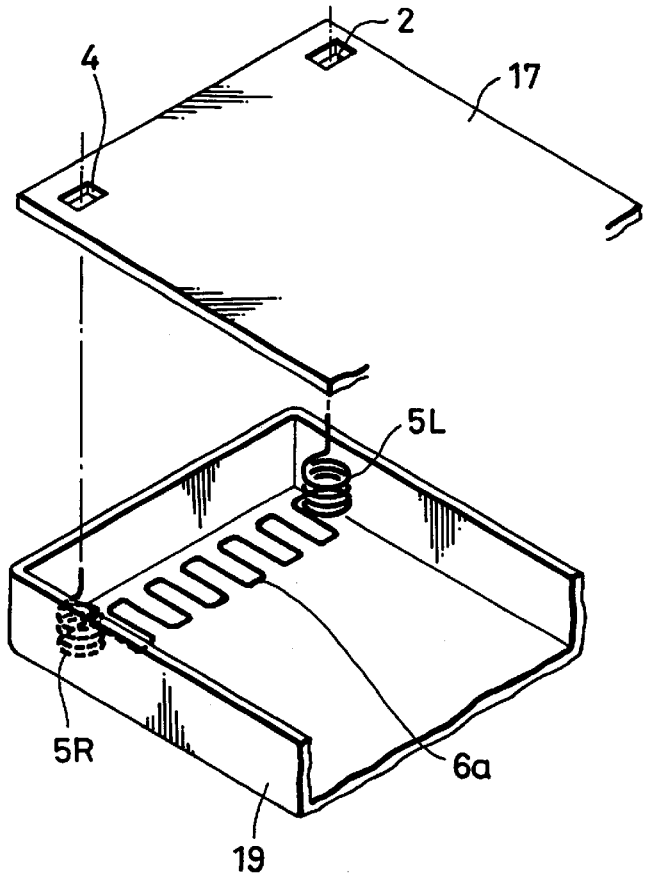
FIGS. 6A and 6B are perspective views (I) showing another attachment states of antenna devices according to the present invention.
Figure 6B:
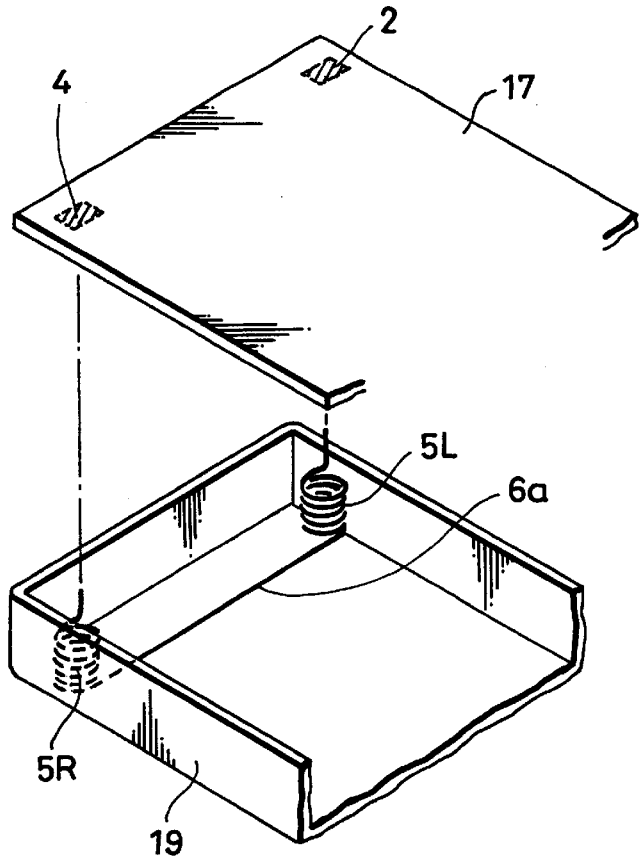

FIGS. 6A and 6B show a case in which the above-described antenna device is fixed to a portable radio receiver such as a portable telephone. The antenna device is fixed to the inside of a housing 19 by a double-sided adhesive tape or a locking member provided on the housing 19 and the antenna device is brought in contact with and electrically connected to the feed portion 2 and the short-circuit portion 4 formed on the substrate 17 by a suitable method such as soldering or contacting under spring force of the spiral-like portions of the conductors 5L and 5R.

Figure 7A:
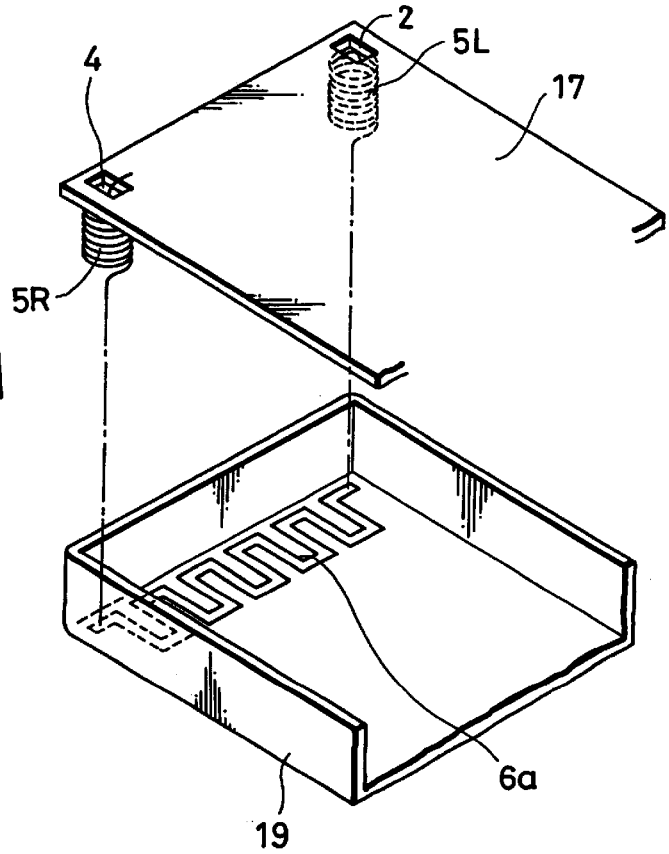
FIGS. 7A and 7B are perspective views (II) showing another attachment states of antenna devices according to the present invention.
Figure 7B:
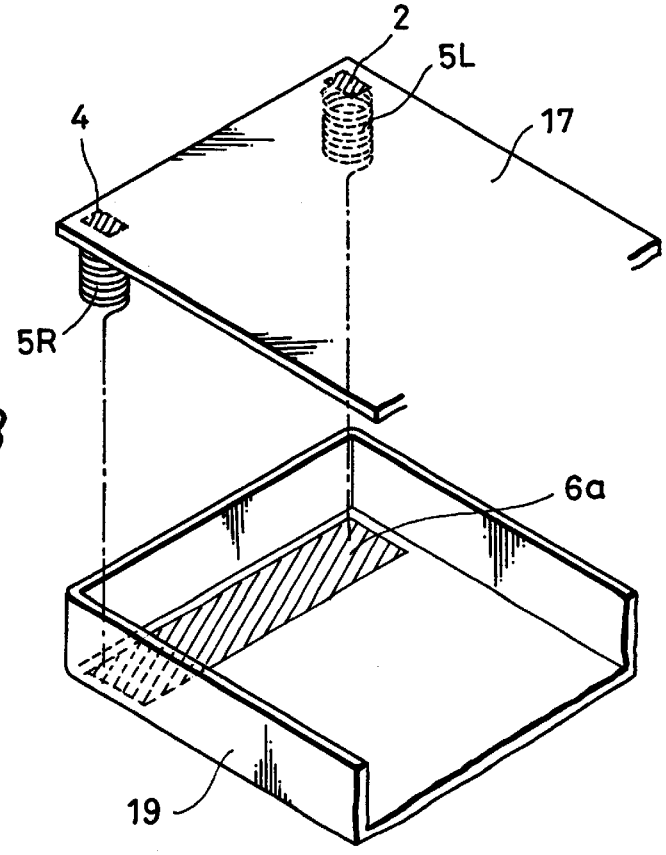

FIGS. 7A and 7B show another case in which the above-described antenna device is fixed to a portable radio receiver such as a portable telephone. The meander-like and linear (rectangullar) third conductor 6*a* formed of the sheet-like conductor is secured to the housing by a suitable means such as a double-sided adhesive tape or hooks provided on the housing 19 of the portable radio receiver and the end portions of the third conductor 6*a* are brought in contact with and electrically connected to the end portions of the first and second conductors 5L, 5R which are secured to the feed portion 2 and the short-circuit portion 4 of the portable radio receiver substrate 17 by a suitable method such as soldering.

Figure 8:
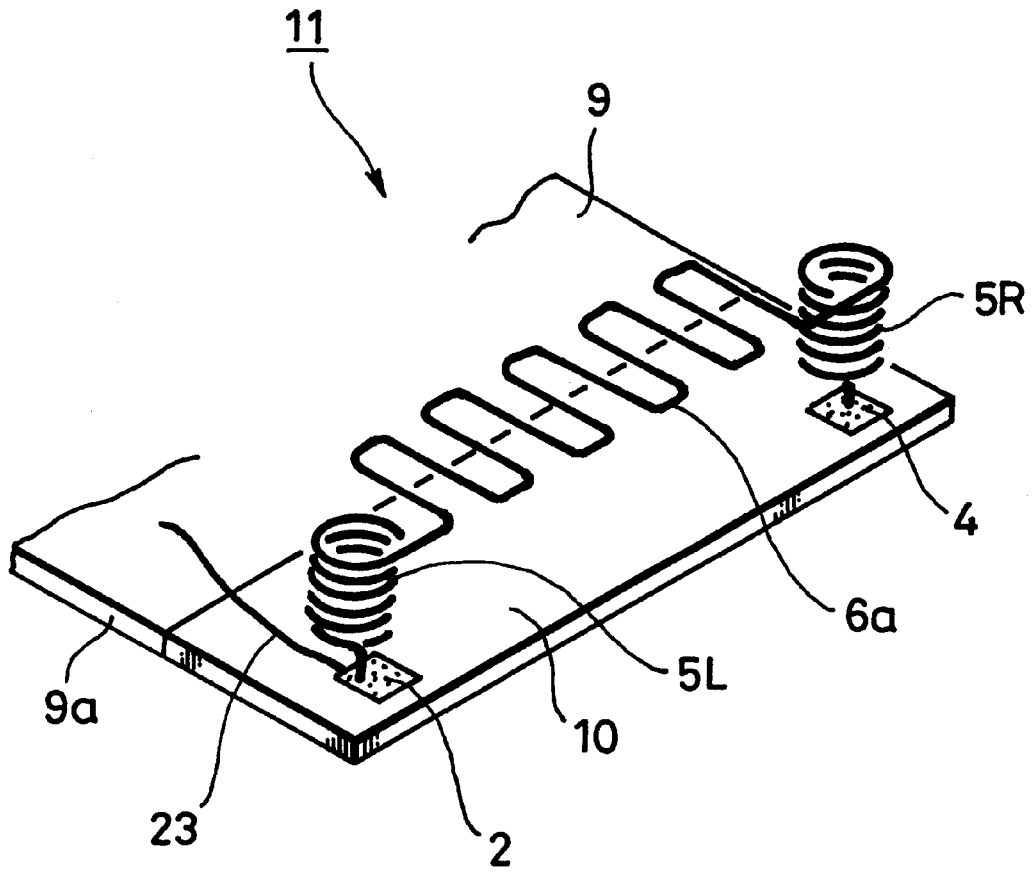
FIG. 8 is a perspective view (III) showing still another attachment state of an antenna device according to the present invention.
Figure 9A:
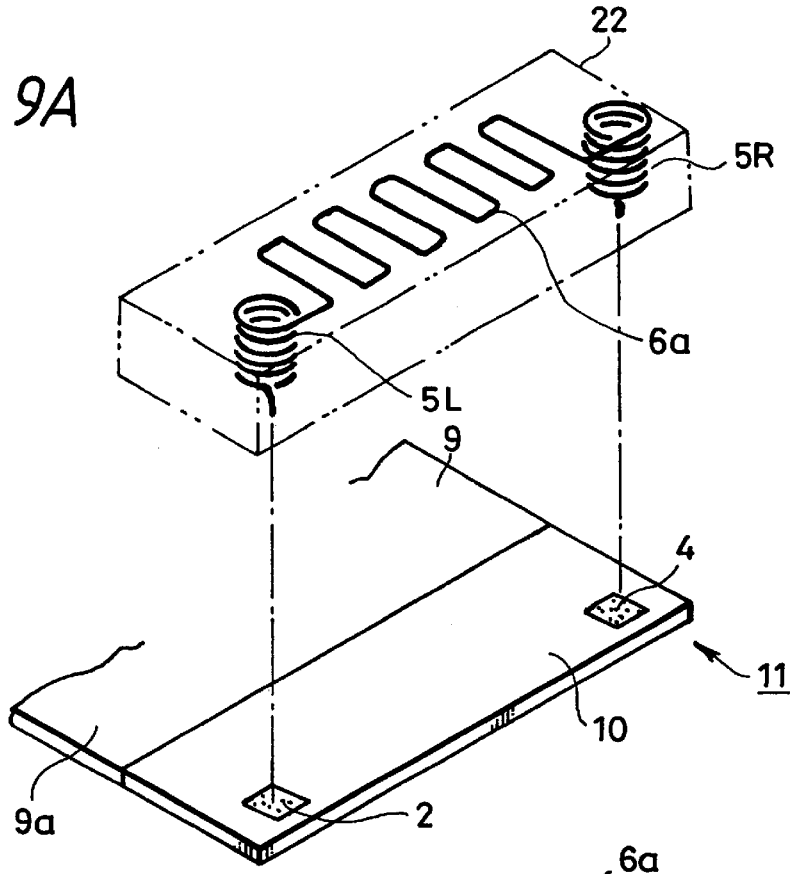
FIGS. 9A and 9B are perspective views (IV) showing still another attachment states of antenna devices according to the present invention.
Figure 9B:
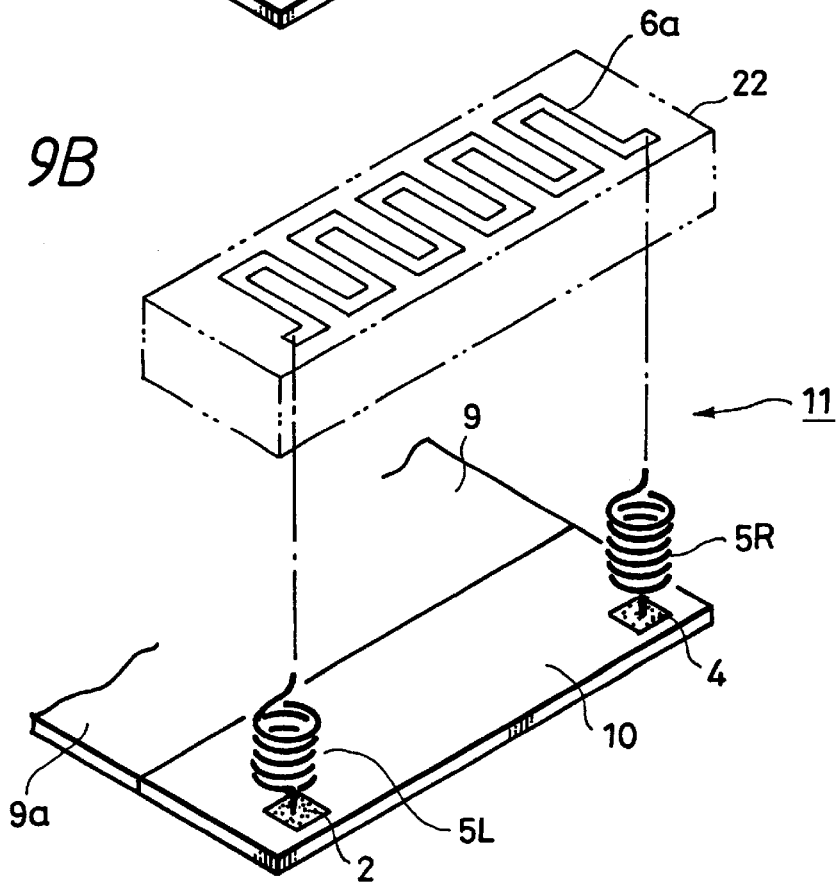
Figure 10A:
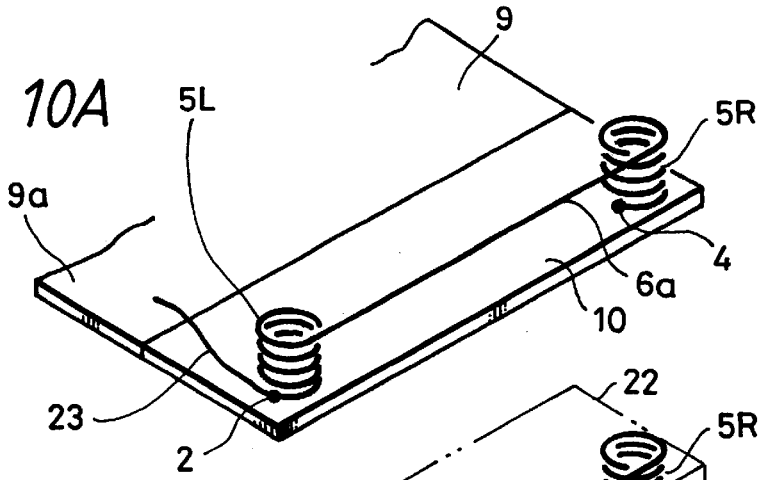
FIGS. 10A to 10C are perspective views (V) showing still another attachment states of the antenna devices according to the present invention.
Figure 10B:
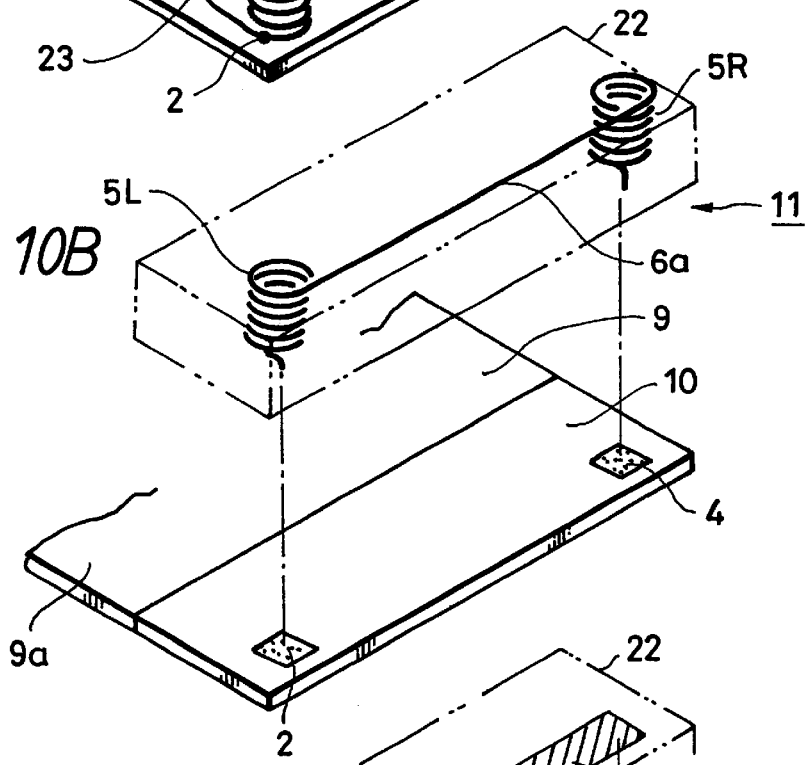
Figure 17:
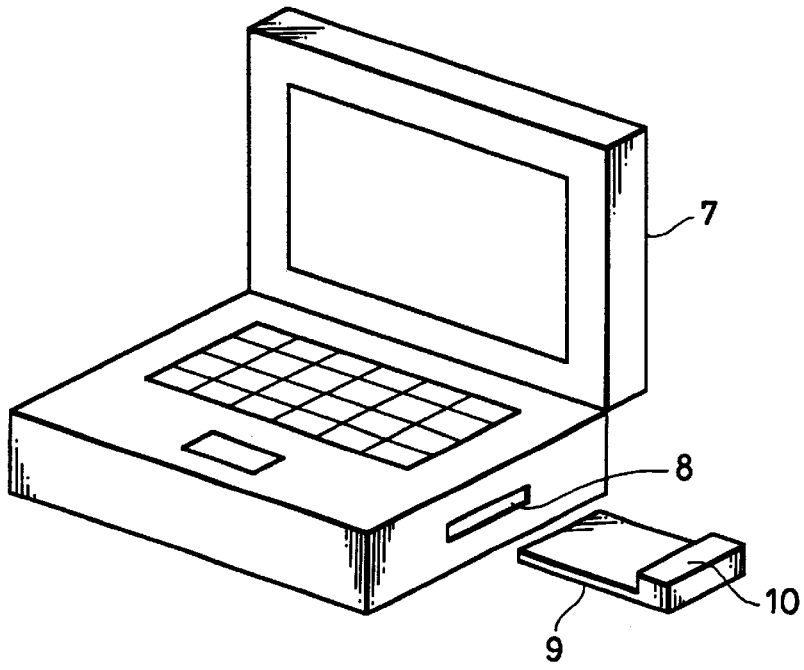
FIG. 17 is a perspective view to which reference will be made in explaining a PC card which is inserted into a notebook size PC according to the prior art.
Figure 18:
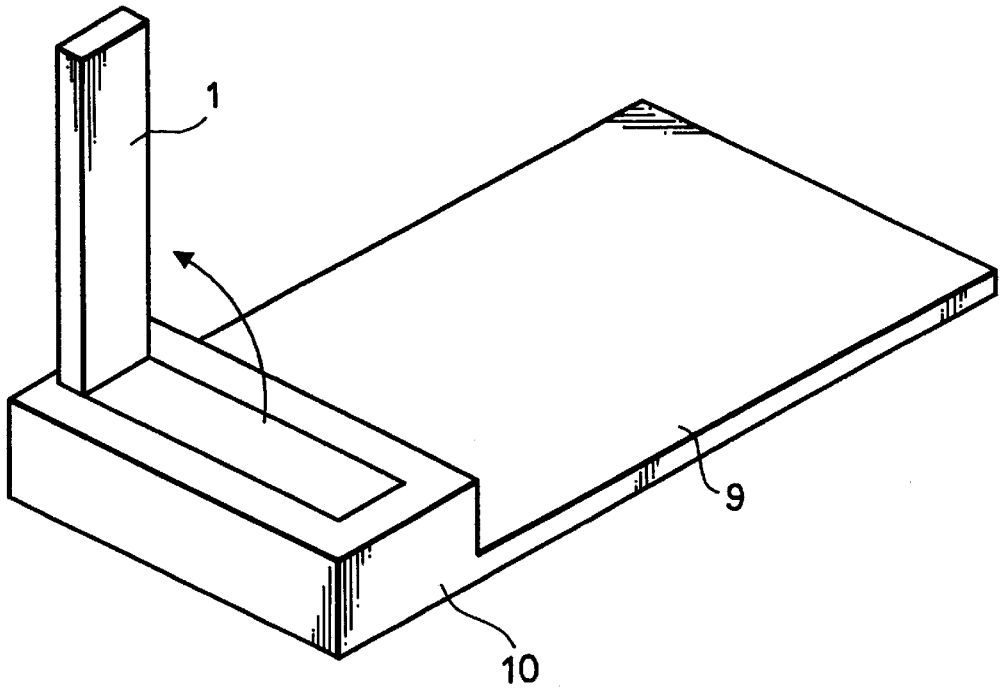
FIG. 18 is a diagram (I) to which reference will be made in explaining an antenna device for use with a PC card according to the prior art.
Figure 19:
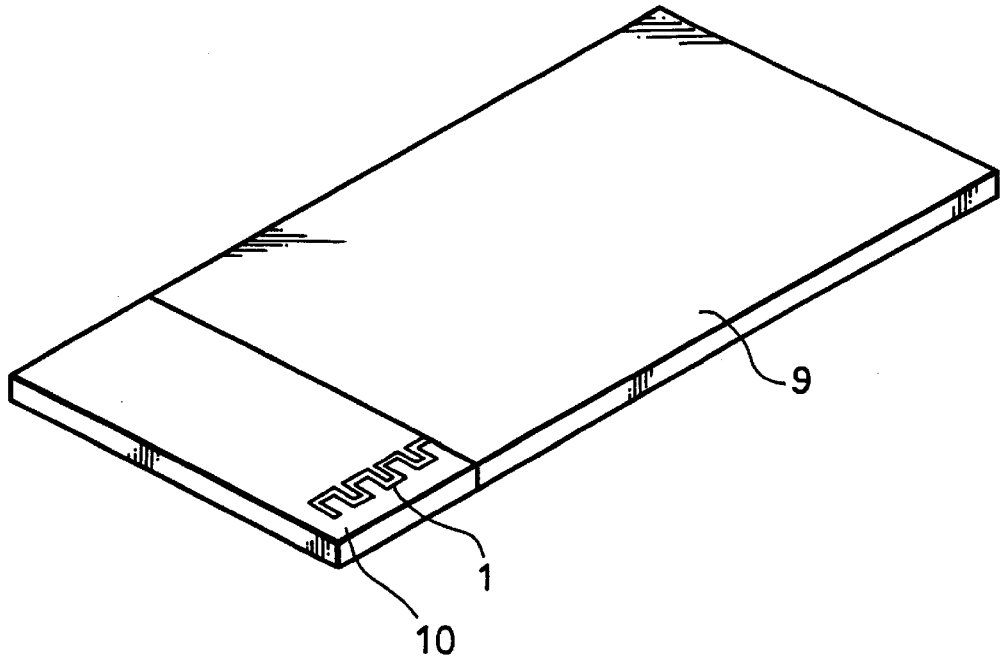
FIG. 19 is a diagram (II) to which reference will be made in explaining an antenna device for use with a PC card according to the prior art.

Antenna devices shown in FIG. 8 and FIGS. 9A, 9B and FIGS. 10A to 10C are those in which antenna devices according to the present invention are mounted on a PC card 9 for use with the notebook-size PC described with reference to FIGS. 17 to 19. In FIG. 8, the radio communication PC card 9 is comprised of a substrate 9*a* and the antenna portion 10 installed on the side opposing the side in which the radio communication PC card 9 is inserted into the PC card slot 8. In FIGS. 8 and 10A, the first and second conductors 5L, 5R formed of a linear conductor such as a piano wire and a phosphor bronze electrically connected to the short-circuit portion 4 and the feed portion 2 on the antenna portion 10 by a suitable method such as soldering are erected substantially vertically on the antenna portion 10 in a spiral fashion. The meander-like or linear third conductor 6*a* is connected to the respective ends of these spiral first and second conductors 5L, 5R. Reference numeral 23 denotes a transmission line.

FIGS. 9A, 9B and FIGS. 10B, 10C show antenna devices in which the antenna device 11 including the conductors 5L, 5R and the third conductor 6*a* having the U-like shape are disposed within a transmitting and receiving antenna housing 22 or the third conductor 6*a* is disposed on the surface of the transmitting and receiving antenna housing 22 and the transmitting and receiving antenna housing 22 is fixed to the antenna portion 10 of the PC card 9. With the above-described arrangement, the transmitting and receiving antenna housing 22 is fixed to the antenna portion 10, whereby the tip ends of the first and second conductors 5L, 5R are brought in contact with the short-circuit portion 4 and the feed portion 2 and thereby electrically conducted in FIG. 9A and FIG. 10B and each one end of the first and second conductors 5L, 5R is brought in contact with the respective ends of the third conductor 6*a* and thereby conducted in FIG. 9B and FIG. 10C.

According to the method of this arrangement, the radio communication transmitting and receiving antenna need not be soldered. Moreover, since the antenna is fixed to the housing, the position of the antenna can be prevented from being fluctuated, antenna characteristics can be stabilized and the antenna device can be miniaturized.

Figure 10C:
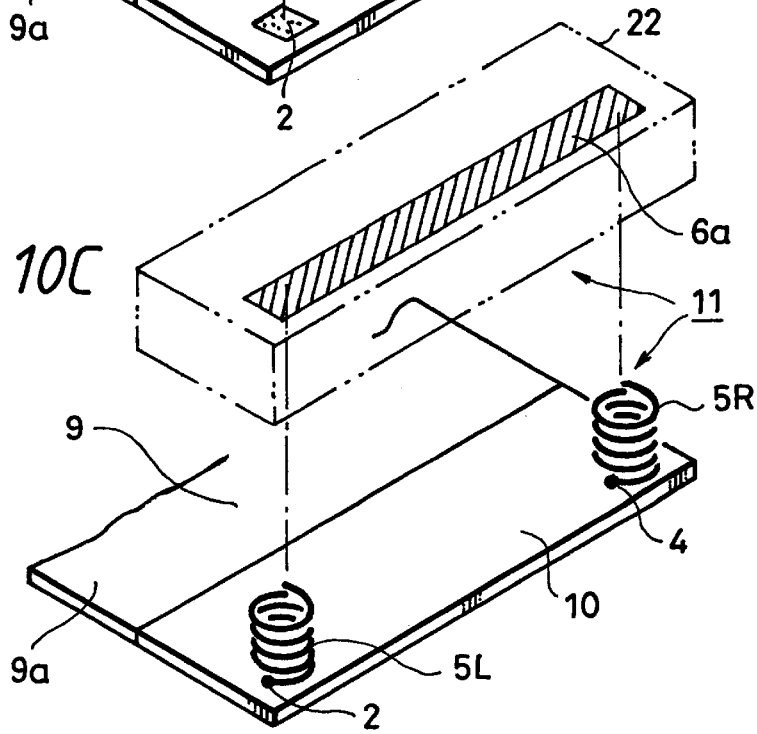
Figure 11A:
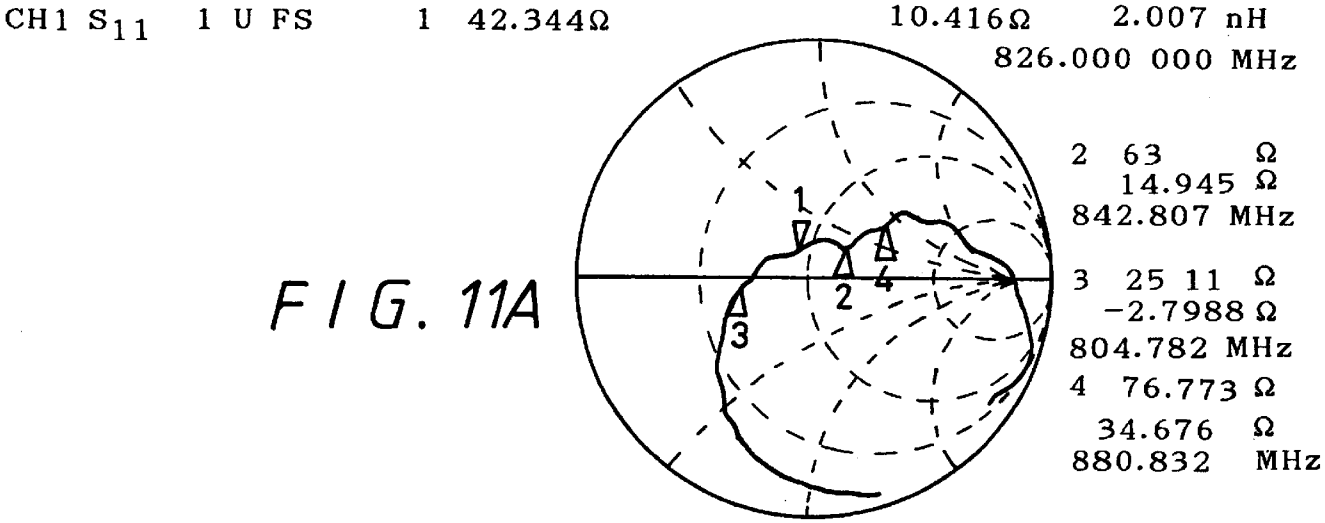
FIGS. 11A and 11B are graphs (I) showing a frequency versus voltage standing wave ratio (VSWR) characteristic of a loop antenna.
Figure 11B:
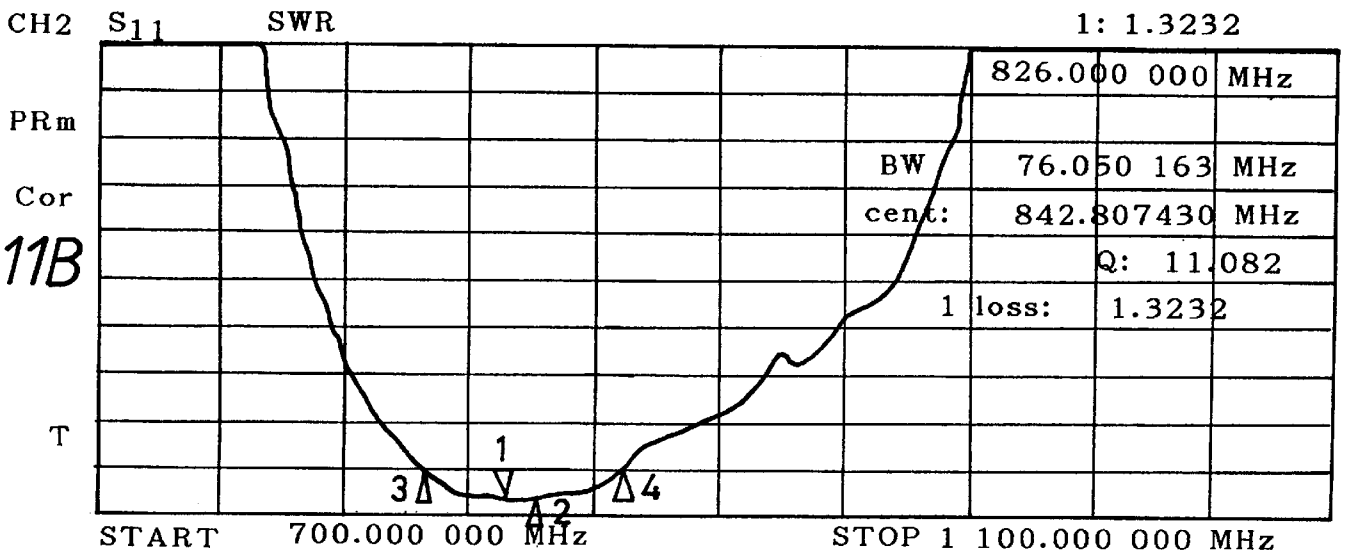
Figure 12A:
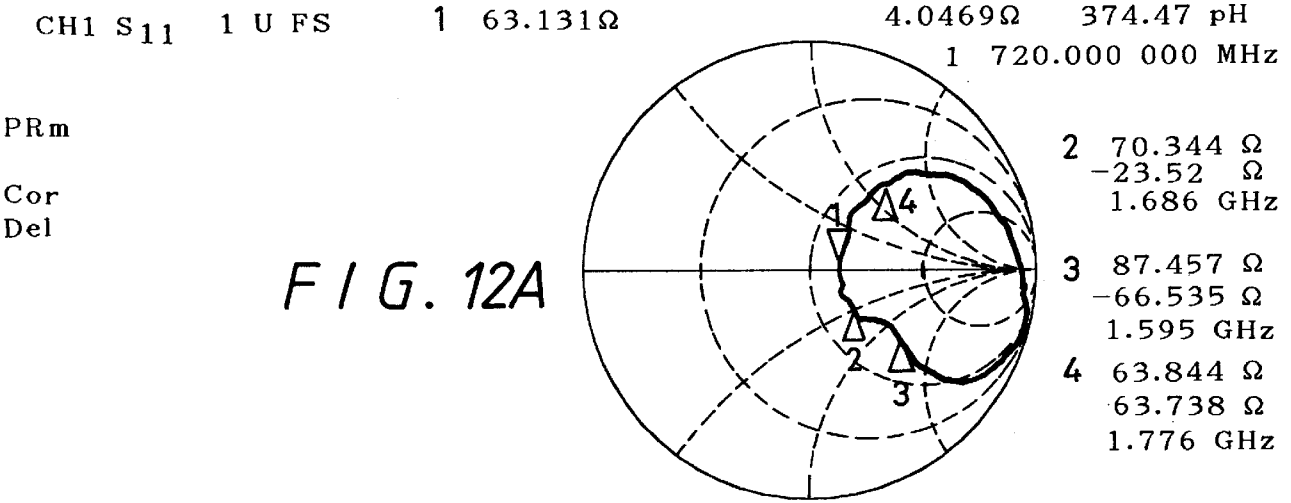
FIGS. 12A and 12B are graphs (II) showing a frequency versus voltage standing wave ratio (VSWR) characteristic of a loop antenna.
Figure 12B:
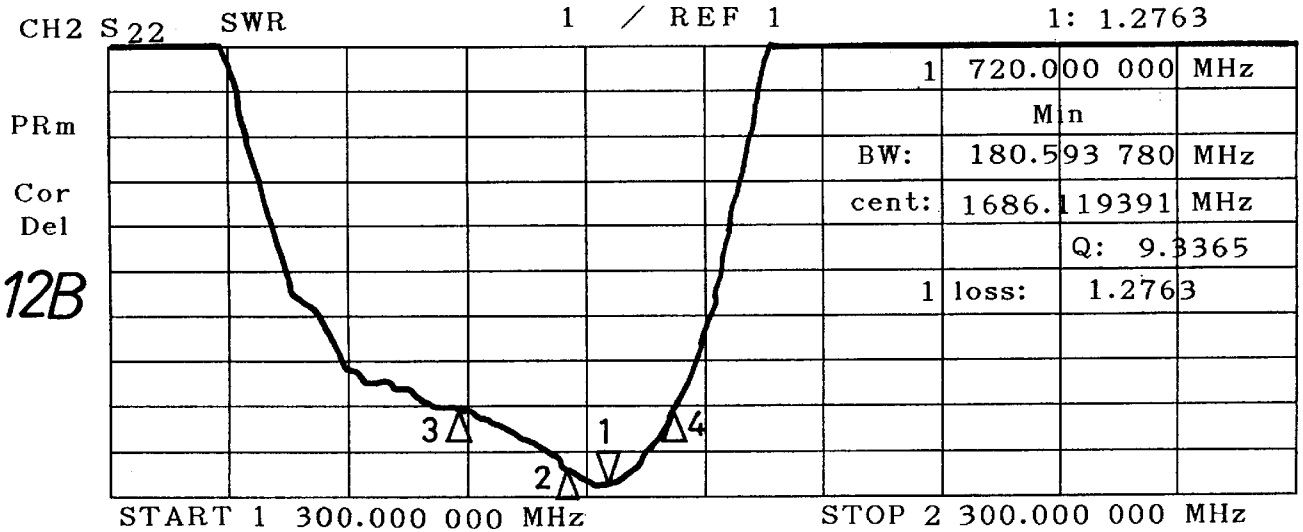

In the antenna devices shown in FIG. 9B and FIG. 10C, the third conductor 6*a* can be patterned on the surface or the rear of the transmitting and receiving antenna housing 22 by a suitable method such as plating.

Figure 13:
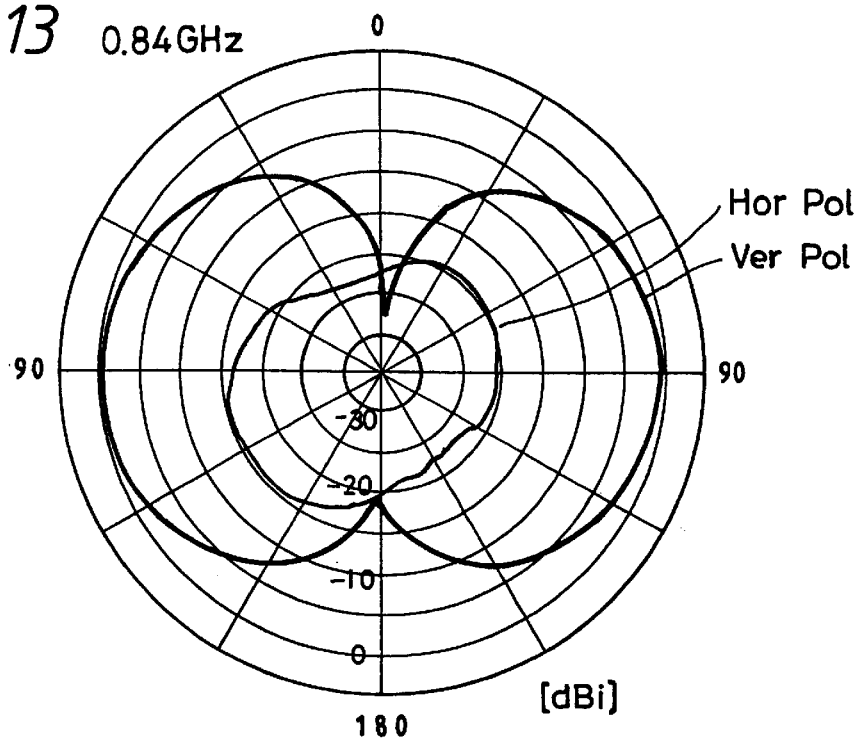
FIG. 13 is a chart showing antenna radiation gains of a loop antenna.
Figure 14:
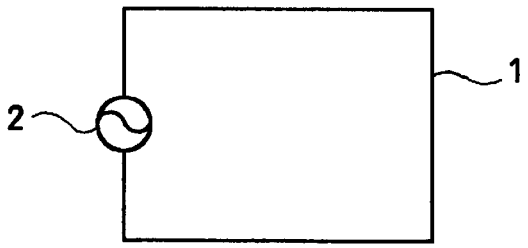
FIG. 14 is a diagram to which reference will be made in explaining a one-wavelength loop antenna according to the prior art.
Figure 15:
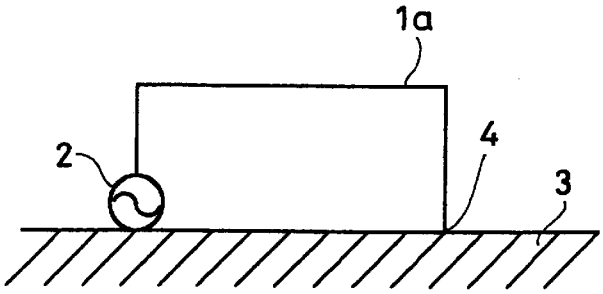
FIG. 15 is a diagram to which reference will be made in explaining a method of miniaturizing a one-wavelength loop antenna according to the prior art.

Antenna radiation gains of the antenna device 11 of the small loop antenna shown in FIG. 1A according to the present invention having the above-described 800 MHz band is shown in FIG. 13. With this radiation characteristics, there can be obtained satisfactory 8-shaped radiation gains whose horizontal (Har Pal) peak gain is 0dBi.

Further, FIGS. 11A, 11B and FIGS. 12A, 12B are Smith charts of the antenna devices 11 shown in FIG. 1A and FIG. 4A and graphs showing frequency versus voltage standing wave ratio (VSWR) characteristics. In FIG. 11, a bandwidth of 76 MHz can be obtained when VSWR≦2. In FIG. 12, a bandwidth of 180 MHz can be obtained when VSWR≦3.

According to the present invention, one-wavelength loop antenna can be miniaturized considerably and can be used in a portable radio receiver for mobile communication which reflects a recent trend in which antenna device is miniaturized increasingly and a PC card. Moreover, even when this antenna device is inserted into the notebook-size PC, antenna characteristics can be prevented from being deteriorated and excellent radio communication quality can be obtained.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A closed one-wavelength loop antenna device comprising:

a grounding conductor including a feed portion and a short-circuit portion;

a first conductor shaped as a first spiral conductor arranged upstanding from said grounding conductor, an end of said first spiral conductor being connected to said feed portion;

a second conductor shaped as a second spiral conductor arranged upstanding from said grounding conductor, an end of said second spiral conductor being connected to said short-circuit portion; and a third conductor electrically connected to an end of said first conductor not connected to said feed portion and electrically connected to an end of said second conductor not connected to said short-circuit and being arranged to be substantially perpendicular to an axis of said first spiral conductor and to an axis of said second spiral conductor.

2. The antenna closed one-wave-length loop device according to claim 1, wherein said third conductor is shaped as a meander conductor.

3. An antenna device according to claim 1, wherein said first and said third conductor is shaped as a linear conductor.

4. The antenna device according to claim 1, wherein said first, said second, and said third conductors are formed of one of shet and wire conductors.

5. The antenna device according to claim 1, wherein said first and said second conductors are formed of wire conductors and said third conductor is formed of a sheet conductor.

6. A portable radio receiver including a closed one-wavelength loop antenna device, said antenna device comprising:

a grounding conductor including a feed portion and a short-circuit portion;

a first conductor shaped as a first spiral conductor arranged upstanding from said grounding conductor, an end of said first spiral conductor being connected to said feed portion;

a second conductor shaped as a second spiral conductor, an end of said second spiral conductor being connected to said short-circuit portion; and a third conductor electrically connected to an end of said first conductor not connected to said feed portion and an end of said second conductor not connected to said short-circuit portion and arranged to be substantially perpendicular to an axis of said first spiral conductor and to an axis of said second spiral conductor.

7. A portable radio communication PC card device including a closed one-wavelength loop antenna device, said antenna device comprising:

a grounding conductor including a feed portion and a short-circuit portion;

a first conductor shaped as a first spiral conductor arranged upstanding from said grounding conductor, an end of said first spiral conductor being connected to said feed portion;

a second conductor shaped a second spiral conductor arranged upstanding from said grounding conductor, an end of said second spiral conductor being connected to said short-circuit portion; and a third conductor electrically connected to an end of said first conductor not connected to said feed portion and electrically connected to an end of said second conductor not connected to said short-circuit portion and being arranged to be substantially perpendicular to an axis of said first spiral conductor and to an axis of said second spiral conductor.

8. A portable radio receiver comprising:

a closed one-wavelength loop antenna device including a grounding conductor including a feed portion and a short-circuit portion, a first conductor shaped as a first spiral conductor arranged upstanding from said grounding conductor and with an end of said first spiral conductor being connected to said feed portion, a second conductor shaped as a second spiral conductor arranged upstanding from said grounding conductor and with an end of said second spiral conductor being connected to said short-circuit portion, and a third conductor electrically connected to an end of said first conductor not connected to said feed portion and to an end of said second conductor not connected to said short-circuit portion and arranged to be substantially perpendicular to an axis of said first spiral conductor and to an axis of said second spiral conductor; and an external connector for connecting said portable radio receiver to a predetermined external device, wherein said antenna device is disposed so as to surround an exterior of said external connector.

9. The portable radio receiver according to claim 8, wherein said first and said second conductors are integrally formed with said external connector of said portable radio receiver.

* * * * *